US011743671B2

(12) United States Patent
Satou et al.

(10) Patent No.: US 11,743,671 B2
(45) Date of Patent: Aug. 29, 2023

(54) SIGNAL PROCESSING DEVICE AND SIGNAL PROCESSING METHOD

(71) Applicant: SONY CORPORATION, Tokyo (JP)

(72) Inventors: Hironori Satou, Tokyo (JP); Toru Nakagawa, Tokyo (JP); Tetsu Magariyachi, Tokyo (JP); Koyuru Okimoto, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/250,603

(22) PCT Filed: Aug. 2, 2019

(86) PCT No.: PCT/JP2019/030413
§ 371 (c)(1),
(2) Date: Feb. 9, 2021

(87) PCT Pub. No.: WO2020/036077
PCT Pub. Date: Feb. 20, 2020

(65) Prior Publication Data

US 2021/0297802 A1 Sep. 23, 2021

(30) Foreign Application Priority Data

Aug. 17, 2018 (JP) ..... 2018-153658

(51) Int. Cl.
*H04S 7/00* (2006.01)
*G10K 15/08* (2006.01)
(Continued)

(52) U.S. Cl.
CPC ..... *H04S 7/303* (2013.01); *G10K 15/08* (2013.01); *H04R 5/02* (2013.01); *H04S 1/002* (2013.01); *H04S 1/007* (2013.01); *H04S 2420/01* (2013.01)

(58) Field of Classification Search
None
See application file for complete search history.

(56) References Cited

U.S. PATENT DOCUMENTS

2003/0026441 A1 2/2003 Faller
2005/0147261 A1* 7/2005 Yeh ..... H04R 3/12 381/26

(Continued)

FOREIGN PATENT DOCUMENTS

CN 102281492 A 12/2011
CN 108476372 A 8/2018

(Continued)

OTHER PUBLICATIONS

International Search Report and Written Opinion of PCT Application No. PCT/JP2019/030413, dated Oct. 8, 2019, 07 pages of ISRWO.

(Continued)

*Primary Examiner* — Qin Zhu
(74) *Attorney, Agent, or Firm* — CHIP LAW GROUP

(57) ABSTRACT

The present disclosure relates to a signal processing device, a signal processing method, and a program that make it possible to readily achieve personalization of head-related transfer functions in all bands. A synthesis unit generates a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured. The present disclosure may be applied to, for example, a mobile terminal such as a smartphone.

13 Claims, 18 Drawing Sheets

(51) Int. Cl.
*H04R 5/02* (2006.01)
*H04S 1/00* (2006.01)

(56) References Cited

U.S. PATENT DOCUMENTS

| | | | | |
|---|---|---|---|---|
| 2011/0305358 | A1* | 12/2011 | Nishio | H04S 7/305 381/303 |
| 2015/0010160 | A1* | 1/2015 | Udesen | H04R 25/70 381/60 |
| 2017/0238111 | A1* | 8/2017 | Kitazawa | H04S 7/304 381/17 |
| 2017/0272890 | A1* | 9/2017 | Oh | H04S 7/304 |
| 2018/0332426 | A1 | 11/2018 | Fujii et al. | |

FOREIGN PATENT DOCUMENTS

| | | | |
|---|---|---|---|
| EP | 3410746 | A1 | 12/2018 |
| JP | 2009-260574 | A | 11/2009 |
| KR | 100754220 | B1 | 9/2007 |
| WO | 2015/166814 | A1 | 11/2015 |
| WO | 2017/130255 | A1 | 8/2017 |

OTHER PUBLICATIONS

Office Action for CN Patent Application No. 201980052823X, dated Mar. 2, 2022, 7 pages of Office Action and 3 pages of English Translation.

* cited by examiner

SIGNAL PROCESSING DEVICE AND SIGNAL PROCESSING METHOD

CROSS REFERENCE TO RELATED APPLICATIONS

This application is a U.S. National Phase of International Patent Application No. PCT/JP2019/030413 filed on Aug. 2, 2019, which claims priority benefit of Japanese Patent Application No. JP 2018-153658 filed in the Japan Patent Office on Aug. 17, 2018. Each of the above-referenced applications is hereby incorporated herein by reference in its entirety.

TECHNICAL FIELD

The present disclosure relates to a signal processing device, a signal processing method, and a program, and in particular, to a signal processing device, a signal processing method, and a program that make it possible to readily achieve personalization of a head-related transfer function.

BACKGROUND ART

There has been known a technique that three-dimensionally reproduces a sound image with headphones using a head-related transfer function (HRTF) that expresses how a sound is transmitted from a sound source to ears.

For example, Patent Document 1 discloses a mobile terminal that reproduces a stereophonic sound using an HRTF measured using a dummy head.

However, due to individuality of the HRTF, accurate sound image localization has not been possible with the HRTF measured using a dummy head. Meanwhile, it has been known that accurate sound image localization can be achieved by measuring a listener's own HRTF to personalize the HRTF.

However, in the case of measuring the listener's own HRTF, it has been necessary to use large-scale equipment such as an anechoic room and a large speaker.

CITATION LIST

Patent Document

Patent Document 1: Japanese Patent Application Laid-Open No. 2009-260574

SUMMARY OF THE INVENTION

Problems to be Solved by the Invention

In view of the above, for example, personalization of the HRTF can be readily achieved without using large-scale equipment if the listener's own HRTF can be measured using a smartphone as a sound source.

However, since a speaker of a smartphone has a narrow reproduction band, measuring an HRTF with sufficient characteristics has not been possible.

The present disclosure has been conceived in view of such a situation, and aims to readily achieve personalization of head-related transfer functions in all bands.

Solutions to Problems

A signal processing device according to the present disclosure is a signal processing device including a synthesis unit that generates a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

A signal processing method according to the present disclosure includes generating a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

A program according to the present disclosure causes a computer to execute a process of generating a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

In the present disclosure, a third head-related transfer function is generated by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

Effects of the Invention

According to the present disclosure, it becomes possible to readily achieve personalization of a head-related transfer function.

Note that the effects described herein are not necessarily limited, and may be any of the effects described in the present disclosure.

MODE FOR CARRYING OUT THE INVENTION

Hereinafter, modes for carrying out the present disclosure (hereinafter referred to as embodiments) will be described. Note that descriptions will be given in the following order.

1. Configuration and operation of a mobile terminal to which the technique according to the present disclosure is applied
2. First embodiment (Measurement of a head-related transfer function for multiple channels)
3. Second embodiment (Measurement of a head-related transfer function in a front direction)
4. Third embodiment (Measurement of a head-related transfer function for a median plane)
5. Others

1. Configuration and Operation of a Mobile Terminal to which the Technique According to the Present Disclosure is Applied (Configuration of Mobile Terminal)

First, an exemplary configuration of a mobile terminal as a signal processing device to which a technique according to the present disclosure is applied will be described with reference to FIG. 1.

Figure 1:
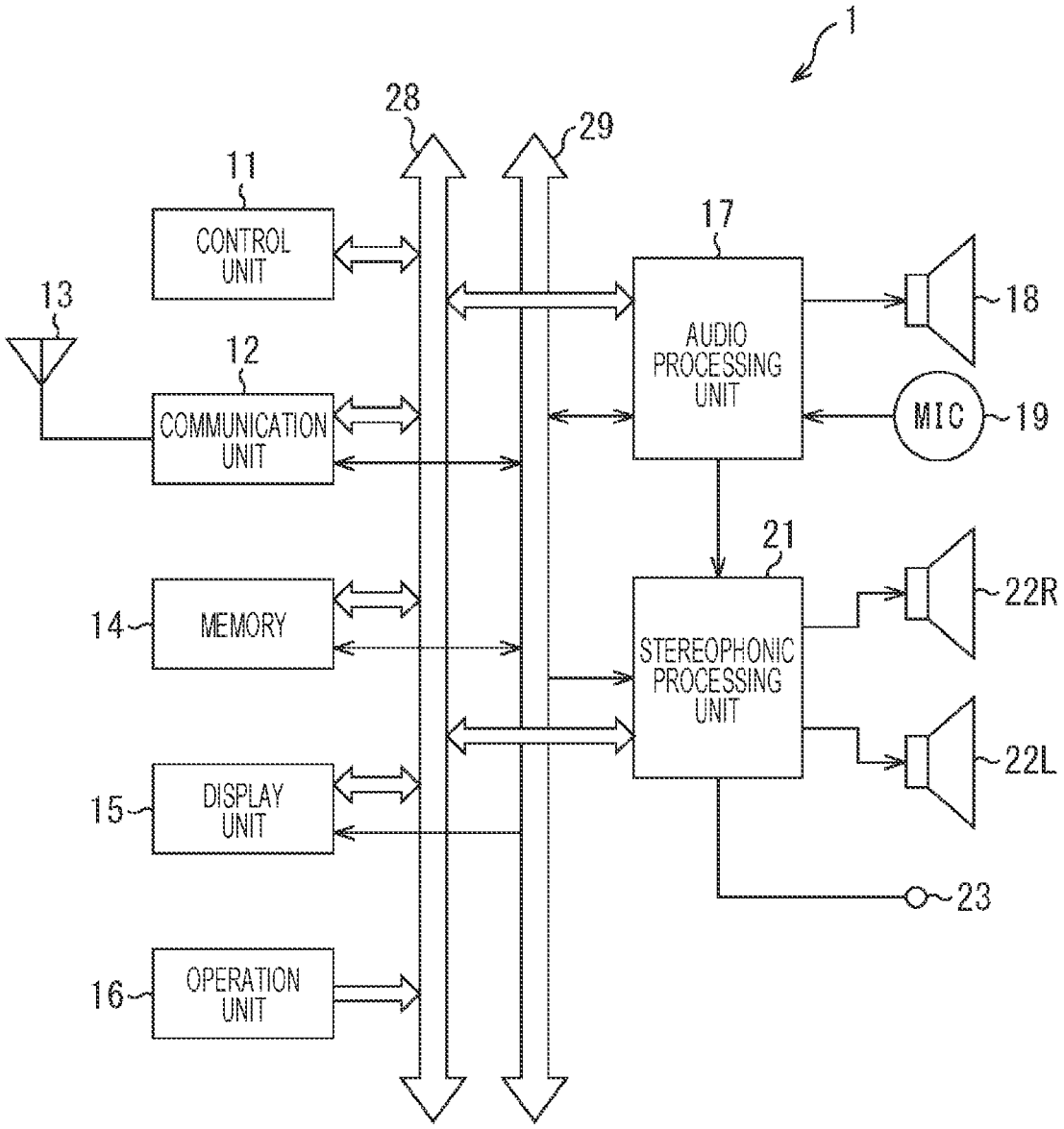
FIG. 1 is a block diagram illustrating an exemplary configuration of a mobile terminal to which a technique according to the present disclosure is applied.

A mobile terminal 1 illustrated in FIG. 1 is configured as, for example, a mobile phone such as what is called a smartphone.

The mobile terminal 1 includes a control unit 11. The control unit 11 controls operation of each unit in the mobile terminal 1. The control unit 11 exchanges data with each unit in the mobile terminal 1 via a control line 28.

Furthermore, the mobile terminal 1 includes a communication unit 12 that performs wireless communication necessary as a communication terminal. An antenna 13 is connected to the communication unit 12. The communication unit 12 wirelessly communicates with a base station for wireless communication, and performs bidirectional data transmission with the base station. The communication unit 12 transmits, via a data line 29, data received from the side of the base station to each unit in the mobile terminal 1. Furthermore, it transmits data transmitted from each unit in the mobile terminal 1 via the data line 29 to the side of the base station.

In addition to the communication unit 12, a memory 14, a display unit 15, an audio processing unit 17, and a stereophonic processing unit 21 are connected to the data line 29.

The memory 14 stores a program necessary for operating the mobile terminal 1, various data stored by a user, and the like. The memory 14 also stores audio signals such as music data obtained by downloading or the like.

The display unit 15 includes a liquid crystal display, an organic electroluminescence (EL) display, or the like, and displays various kinds of information under the control of the control unit 11.

The operation unit 16 includes a touch panel integrated with the display included in the display unit 15, a physical button provided on the housing of the mobile terminal 1, and the like. The display unit 15 as a touch panel (operation unit 16) displays buttons representing dial keys such as numbers and symbols, various function keys, and the like. Operational information of each button is supplied to the control unit 11.

The audio processing unit 17 is a processing unit that processes audio signals, and a speaker 18 and a microphone 19 are connected thereto. The speaker 18 and the microphone 19 function as a handset during a call.

The audio data supplied from the communication unit 12 to the audio processing unit 17 is demodulated by the audio processing unit 17 to be analog audio signals, which are subject to analog processing such as amplification and emitted from the speaker 18. Furthermore, the audio signals of voice collected by the microphone 19 are modulated by the audio processing unit 17 into digital audio data, and the modulated audio data is supplied to the communication unit 12 to perform wireless transmission and the like.

Furthermore, among the audio data supplied to the audio processing unit 17, the voice output as stereophonic sound is supplied to the stereophonic processing unit 21, and is processed.

The stereophonic processing unit 21 generates two-channel audio signals that reproduce binaural stereophonic sound. The audio signals to be processed by the stereophonic processing unit 21 may be, in addition to being supplied from the audio processing unit 17, read from the memory 14 and the like to be supplied through the data line 29, or the audio data received by the communication unit 12 may be supplied through the data line 29.

The audio signals generated by the stereophonic processing unit 21 are output from two speakers 22L and 22R for the left and right channels built in the main unit of the mobile terminal 1, or output from headphones (not illustrated) connected to an output terminal 23.

The speakers 22L and 22R are speakers using a relatively small speaker unit built in the main body of the mobile terminal 1, which are speakers that amplify and output reproduced sound to the extent that listeners around the main body of the mobile terminal 1 can hear the reproduced sound.

In the case of outputting the audio signals from headphones (not illustrated), in addition to directly connecting the headphones to the output terminal 23 by wire, for example, wireless communication may be performed with the headphones using a scheme such as Bluetooth (registered trademark) to supply the audio signals to the headphones.

Figure 2:
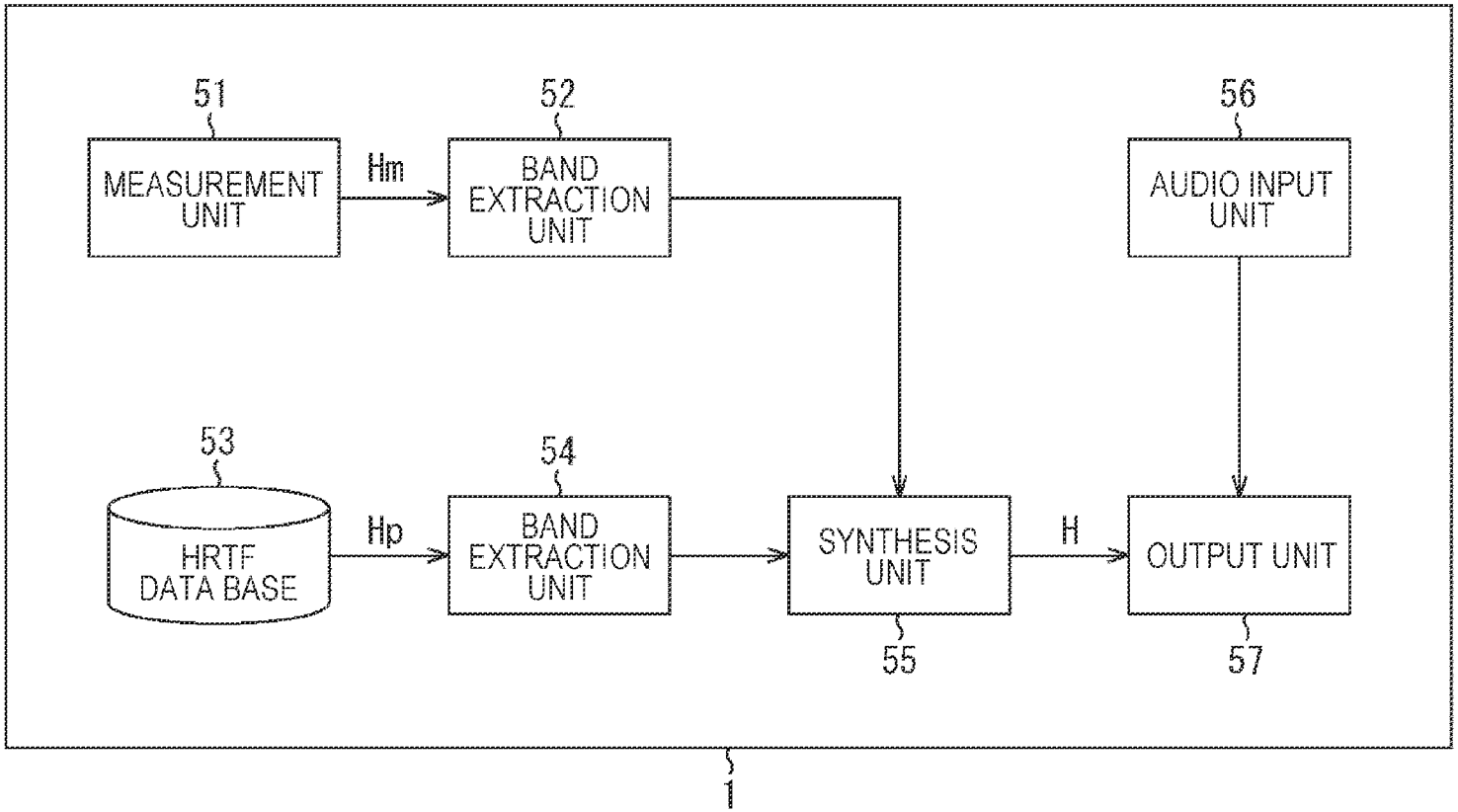
FIG. 2 is a block diagram illustrating an exemplary functional configuration of the mobile terminal.

FIG. 2 is a block diagram illustrating an exemplary functional configuration of the mobile terminal 1 described above.

The mobile terminal 1 of FIG. 2 includes a measurement unit 51, a band extraction unit 52, an HRTF database 53, a band extraction unit 54, a synthesis unit 55, an audio input unit 56, and an output unit 57.

The measurement unit 51 measures a head-related transfer function (HRTF) of the user who handles the mobile terminal 1. For example, the measurement unit 51 obtains the head-related transfer function on the basis of a sound source that reproduces measurement sound waves such as impulse signals, which is disposed in one or a plurality of directions with respect to the user.

It is sufficient if the sound source for reproducing the measurement sound waves is one device including at least one speaker, and the speaker does not necessarily have to have a wide reproduction band.

For example, the sound source for reproducing the measurement sound waves may be the speaker 18 of the mobile terminal 1. In this case, the user arranges the mobile terminal 1 in a predetermined direction, and causes a microphone (not illustrated) worn on the left and right ears of the user to collect the measurement sound waves from the speaker 18. The measurement unit 51 obtains a head-related transfer function Hm of the user on the basis of the audio signals from the microphone supplied by a predetermined means.

The band extraction unit 52 extracts characteristics of a first band from the head-related transfer function Hm measured by the measurement unit 51. The extracted head-related transfer function Hm of the first band is supplied to the synthesis unit 55.

The HRTF database 53 retains a head-related transfer function Hp measured in a measurement environment different from the current measurement environment in which the head-related transfer function Hm is measured. The head-related transfer function Hp is defined as preset data measured in advance, unlike the head-related transfer function Hm actually measured using, for example, the speaker 18 of the mobile terminal 1 arranged by the user. The head-related transfer function Hp is defined as, for example, a head-related transfer function measured in an ideal measurement environment equipped with facilities such as an anechoic room and a large speaker for a dummy head or a person with average-shaped head and ears.

The band extraction unit 54 extracts characteristics of a second band other than the first band mentioned above from the head-related transfer function Hp stored in the HRTF database 53. The extracted head-related transfer function Hp of the second band is supplied to the synthesis unit 55.

The synthesis unit 55 synthesizes the head-related transfer function Hm of the first band from the band extraction unit 52 and the head-related transfer function Hp of the second band from the band extraction unit 54, thereby generating a head-related transfer function H in all bands. That is, the head-related transfer function H is a head-related transfer function having the frequency characteristics of the head-related transfer function Hm for the first band and the frequency characteristics of the head-related transfer function Hp for the second band. The generated head-related transfer function H is supplied to the output unit 57.

The audio input unit 56 inputs, to the output unit 57, audio signals to be a source of the stereophonic sound to be reproduced.

The output unit 57 convolves the head-related transfer function H from the synthesis unit 55 with respect to the audio signals input from the audio input unit 56, and outputs the signals as two-channel audio signals. The audio signals output from the output unit 57 are audio signals that reproduce binaural stereophonic sound.

(Operation of Mobile Terminal)

Figure 3:
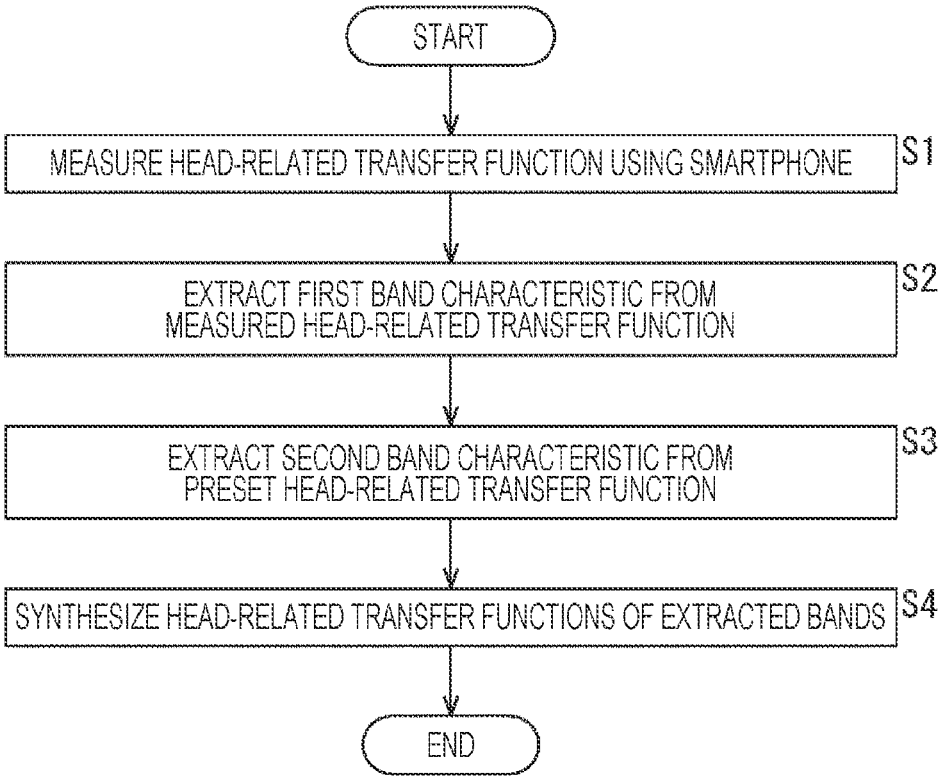
FIG. 3 is a flowchart illustrating a process of generating a head-related transfer function.

Next, the process of generating the head-related transfer function by the mobile terminal 1 will be described with reference to the flowchart of FIG. 3.

In step S1, the measurement unit 51 measures the head-related transfer function Hm by using a smartphone (mobile terminal 1) as a sound source.

In step S2, the band extraction unit 52 extracts the characteristics of the first band from the measured head-related transfer function Hm. The first band may be a band from a predetermined first frequency f1 to a second frequency f2 higher than the frequency f1, or may simply be a band higher than the frequency f1. The first band is defined as a band in which individual-dependent characteristics are particularly likely to appear.

In step S3, the band extraction unit 54 extracts the characteristics of the second band from the preset head-related transfer function Hp retained in the HRTF database 53. The second band may be a band including a band lower than the frequency f1 and a band higher than the frequency f2, or may simply be a band including a band lower than the frequency f1. The second band is defined as a band in which individual-dependent characteristics are unlikely to appear and cannot be reproduced by a smartphone, for example.

In step S4, the synthesis unit 55 generates the head-related transfer function H by synthesizing the extracted head-related transfer function Hm of the first band and the head-related transfer function Hp of the second band.

According to the process described above, the characteristics of the band in which individual-dependent characteristics are likely to appear are extracted from the actually measured head-related transfer function, and the characteristics of the band in which individual-dependent characteristics are unlikely to appear and cannot be reproduced by a smartphone are extracted from the preset head-related transfer function. Therefore, even in a case where the head-related transfer function of the user is measured using a smartphone with a narrow reproduction band as a sound source, it becomes possible to obtain a head-related transfer function with sufficient characteristics, whereby personalization of the head-related transfer functions in all bands can be readily achieved without using large-scale equipment.

Hereinafter, embodiments according to the technique of the present disclosure will be described.

2. First Embodiment (Configuration of Mobile Terminal)

Figure 4:
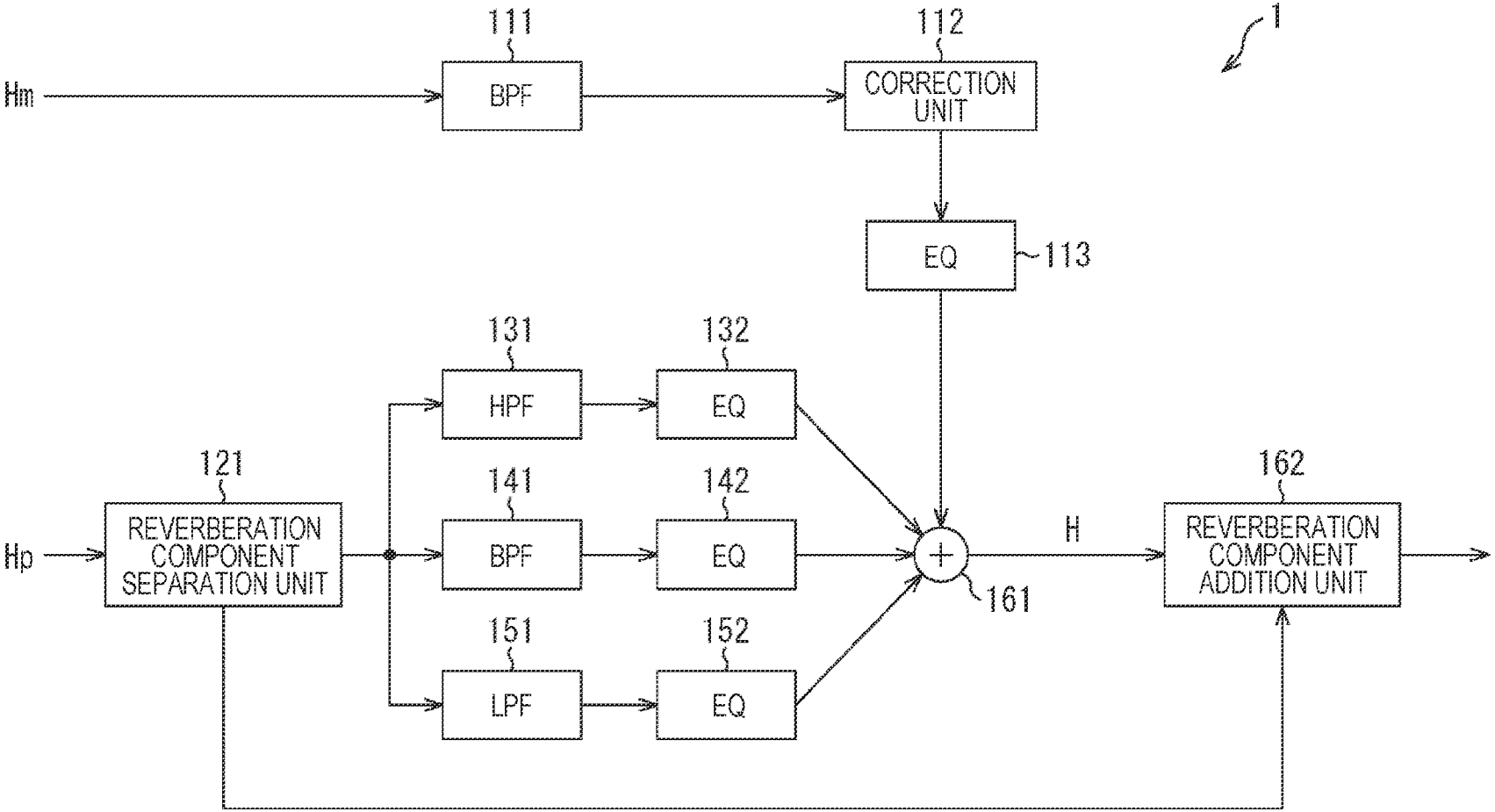
FIG. 4 is a block diagram illustrating an exemplary configuration of a mobile terminal according to a first embodiment.

FIG. 4 is a diagram illustrating an exemplary configuration of a mobile terminal 1 according to a first embodiment of the technique of the present disclosure.

The mobile terminal 1 of FIG. 4 includes a bandpass filter 111, a correction unit 112, and an equalizer 113. Moreover, the mobile terminal 1 includes a reverberation component separation unit 121, a high-pass filter 131, an equalizer 132, a bandpass filter 141, an equalizer 142, a low-pass filter 151, an equalizer 152, a synthesis unit 161, and a reverberation component addition unit 162.

The bandpass filter 111 extracts characteristics of a midrange from the actually measured head-related transfer function Hm. The midrange is defined as a band from the predetermined first frequency f1 to the second frequency f2 higher than the frequency f1. The extracted head-related transfer function Hm of the midrange is supplied to the correction unit 112.

The correction unit 112 corrects, using the inverse characteristic of the speaker 18 of the mobile terminal 1, the head-related transfer function Hm in such a manner that the characteristic of the speaker 18 included in the head-related transfer function Hm is removed. The inverse characteristic of the speaker 18 is preset data measured in advance, which indicates a different characteristic for each model of the mobile terminal 1. The head-related transfer function Hm of the midrange from which the characteristic of the speaker 18 has been removed is supplied to the equalizer 113.

The equalizer 113 adjusts the frequency characteristics of the midrange head-related transfer function Hm, and outputs it to the synthesis unit 161.

The reverberation component separation unit 121 separates a direct component and a reverberation component in a head impulse response expressing the head-related transfer function Hp, which is preset data, in a time domain. The separated reverberation component is supplied to the reverberation component addition unit 162. The head-related transfer function Hp corresponding to the separated direct component is supplied to each of the high-pass filter 131, the bandpass filter 141, and the low-pass filter 151.

The high-pass filter 131 extracts high-frequency characteristics from the head-related transfer function Hp. The high-frequency band is defined as a band higher than the frequency f2 described above. The extracted high-frequency head-related transfer function Hp is supplied to the equalizer 132.

The equalizer 132 adjusts the frequency characteristics of the high-frequency head-related transfer function Hp, and outputs it to the synthesis unit 161.

The bandpass filter 141 extracts midrange characteristics from the head-related transfer function Hp. The extracted midrange head-related transfer function Hp is supplied to the equalizer 142.

The equalizer 142 adjusts the frequency characteristics of the midrange head-related transfer function Hp, and outputs it to the synthesis unit 161. At this time, the midrange head-related transfer function Hp may be subject to a process of setting its gain to zero or substantially zero.

The low-pass filter 151 extracts low-frequency characteristics from the head-related transfer function Hp. The low-frequency band is defined as a band lower than the frequency f1 described above. The extracted low-frequency head-related transfer function Hm is supplied to the equalizer 152.

The equalizer 152 adjusts the frequency characteristics of the low-frequency head-related transfer function Hp, and outputs it to the synthesis unit 161.

The synthesis unit 161 synthesizes the midrange head-related transfer function Hm from the equalizer 113, the high-frequency head-related transfer function Hp from the equalizer 132, and the low-frequency head-related transfer function Hp from the equalizer 152 to generate the head-related transfer function H in all bands. The generated head-related transfer function H is supplied to the reverberation component addition unit 162.

The reverberation component addition unit 162 adds the reverberation component from the reverberation component separation unit 121 to the head-related transfer function H from the synthesis unit 161. The head-related transfer function H to which the reverberation component is added is used for convolution in the output unit 57.

(Process of Generating Head-Related Transfer Function)

Figure 5:
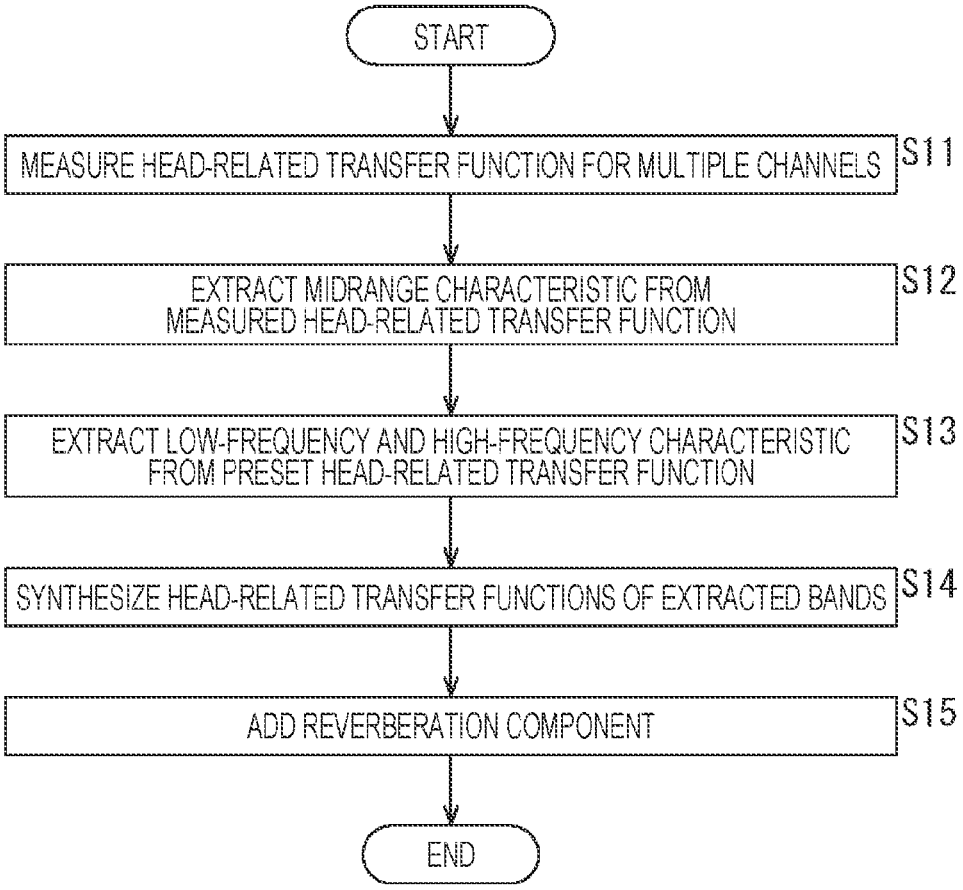
FIG. 5 is a flowchart illustrating a process of generating a head-related transfer function.

FIG. 5 is a flowchart illustrating the process of generating the head-related transfer function performed by the mobile terminal 1 of FIG. 4.

In step S11, the measurement unit 51 (FIG. 2) measures the head-related transfer function Hm for multiple channels by using a smartphone (mobile terminal 1) as a sound source. Accordingly, it becomes possible to localize virtual sound sources for the number of channels for which the head-related transfer function has been measured.

Figure 6A:
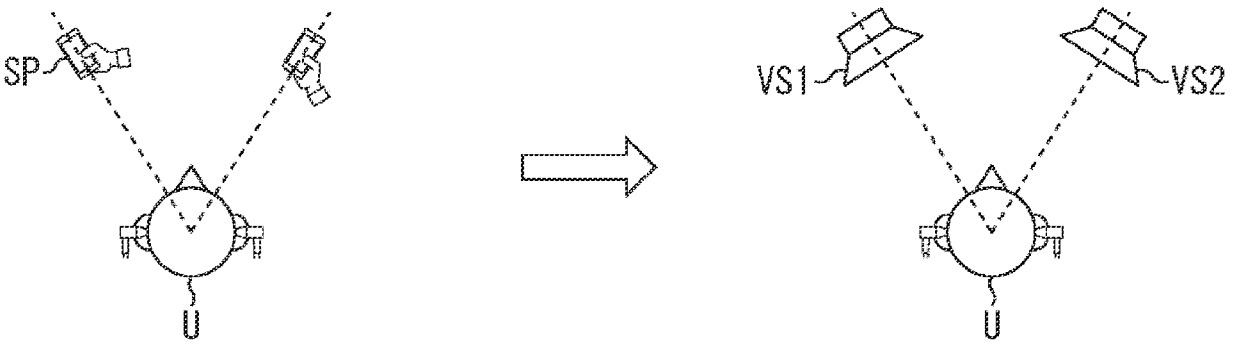
FIGS. 6A and 6B are diagrams illustrating measurement of the head-related transfer function for multiple channels.

For example, as illustrated in the left figure of A of FIG. 6A, it is assumed that a user U has measured the head-related transfer function while holding a smartphone SP in his/her hand and extending his/her arm diagonally forward left and right. In this case, as illustrated in the right figure of FIG. 6A, virtual sound sources VS1 and VS2 can be localized in the left and right diagonal fronts of the user U, respectively.

Figure 6B:
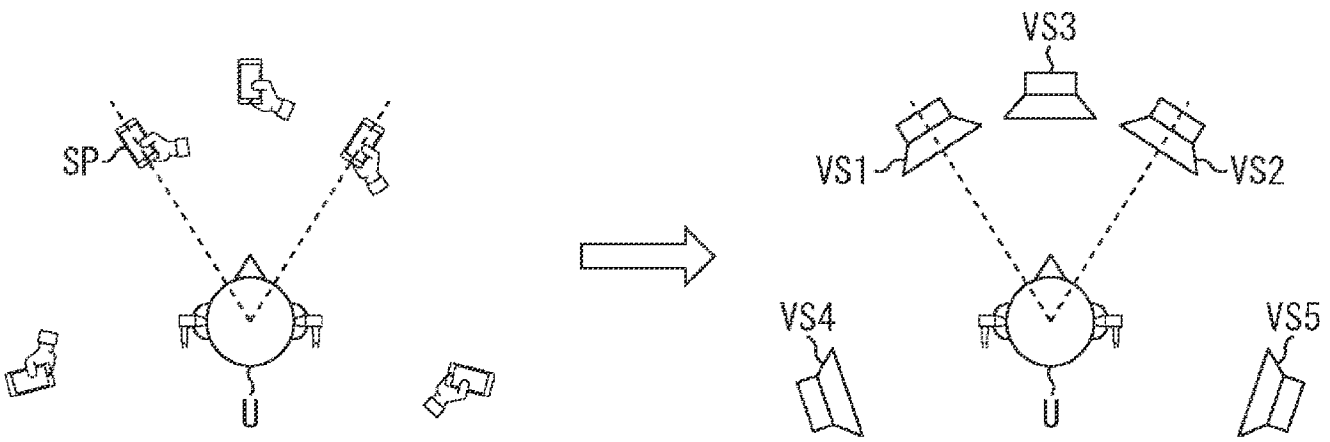

Furthermore, as illustrated in the left figure of FIG. 6B, it is assumed that the user U has measured the head-related transfer function while holding the smartphone SP in his/her hand and extending his/her arm in front of him/her, diagonally forward left and right, and laterally left and right. In this case, as illustrated in the right figure of FIG. 6B, virtual sound sources VS1, VS2, VS3, VS4, and VS5 can be localized in front, diagonally forward left and right, and laterally left and right of the user U, respectively.

In step S12, the bandpass filter 111 extracts midrange characteristics from the measured head-related transfer function Hm. The frequency characteristics of the extracted midrange head-related transfer function Hm are adjusted by the equalizer 113 after the characteristics of the speaker 18 are removed by the correction unit 112.

In step S13, the high-pass filter 131 and the low-pass filter 151 extract low-frequency and high-frequency characteristics from the preset head-related transfer function Hp retained in the HRTF database 53. The frequency characteristics of the extracted low-frequency head-related transfer function Hp are adjusted by the equalizer 152, and the frequency characteristics of the high-frequency head-related transfer function Hp are adjusted by the equalizer 132. The processing of step S13 may be performed in advance.

Note that the reverberation component is separated by the reverberation component separation unit 121 from the head impulse response corresponding to the preset head-related transfer function Hp. The separated reverberation component is supplied to the reverberation component addition unit 162.

In step S14, the synthesis unit 161 generates the head-related transfer function H by synthesizing the extracted low-frequency head-related transfer function Hm and the low-frequency and high-frequency head-related transfer function Hp.

Figure 7A:
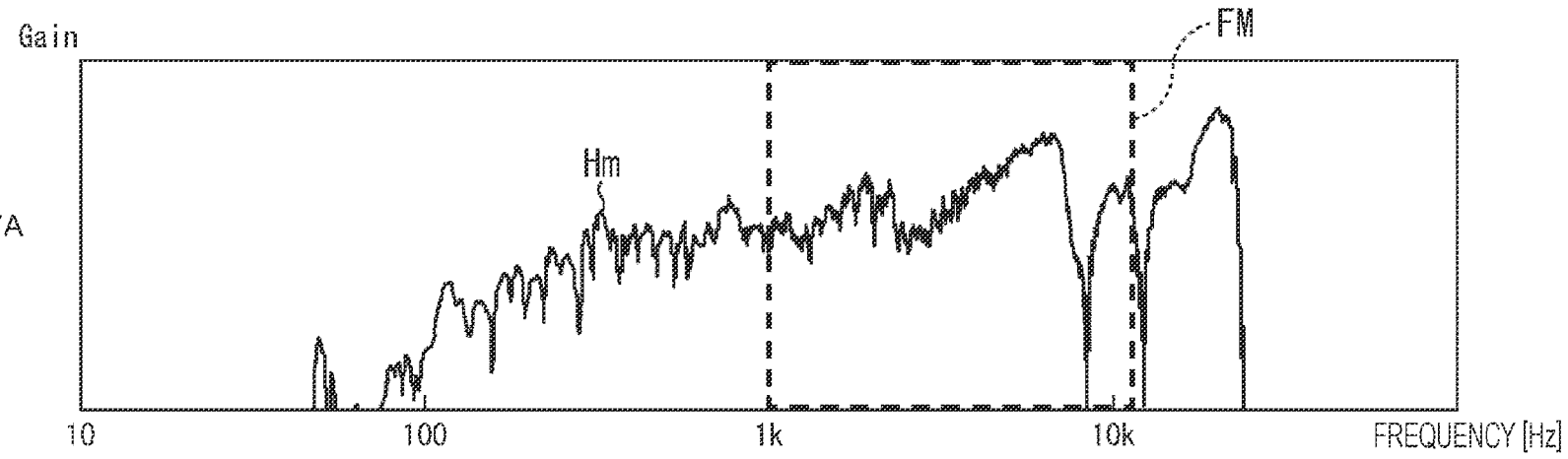
FIGS. 7A and 7B are graphs illustrating band extraction of the head-related transfer function.
Figure 7B:
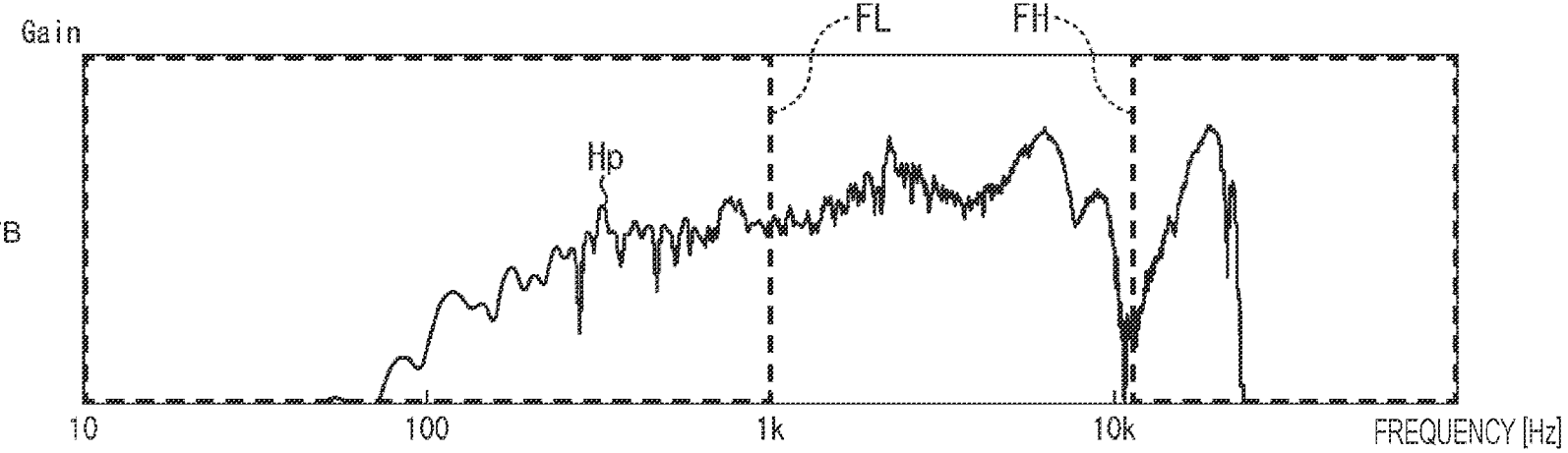

FIGS. 7A and 7B are graphs illustrating the frequency characteristics of the actually measured head-related transfer function Hm and the preset head-related transfer function Hp, respectively.

In FIG. 7A, the characteristics of the band surrounded by the broken line frame FM indicate the midrange characteristics to be extracted from the head-related transfer function Hm by the bandpass filter 111. The midrange is defined as a band from 1 kHz to 12 kHz, for example.

Meanwhile, in FIG. 7B, the characteristics of the band surrounded by the broken line frame FL indicate the low-frequency characteristics to be extracted from the head-related transfer function Hp by the low-pass filter 151. The low-frequency is defined as a band lower than 1 kHz, for example. Furthermore, in FIG. 7B, the characteristics of the band surrounded by the broken line frame FH indicate the high-frequency characteristics to be extracted from the head-related transfer function Hp by the high-pass filter 131. The high-frequency is defined as a band higher than 12 kHz, for example.

The head-related transfer function Hm of the band from 1 kHz to 12 kHz and the head-related transfer function Hp of the band lower than 1 kHz and the band higher than 12 kHz extracted in this manner are synthesized, thereby generating the head-related transfer function H in all bands.

In the band lower than 1 kHz, which cannot be reproduced by a smartphone with a small speaker diameter and a narrow reproduction band, individual-dependent characteristics are unlikely to appear in the head-related transfer function, and sufficient sound image localization accuracy can be obtained even in the case of being replaced with preset characteristics. Furthermore, the band higher than 12 kHz has little contribution to the sound image localization, and even in the case of being replaced with preset characteristics, the sound image localization accuracy is not affected, and high sound quality is expected on the basis of the preset characteristics.

In step S15, the reverberation component addition unit 162 adds the reverberation component from the reverberation component separation unit 121 to the head-related transfer function H from the synthesis unit 161.

Figure 8A:
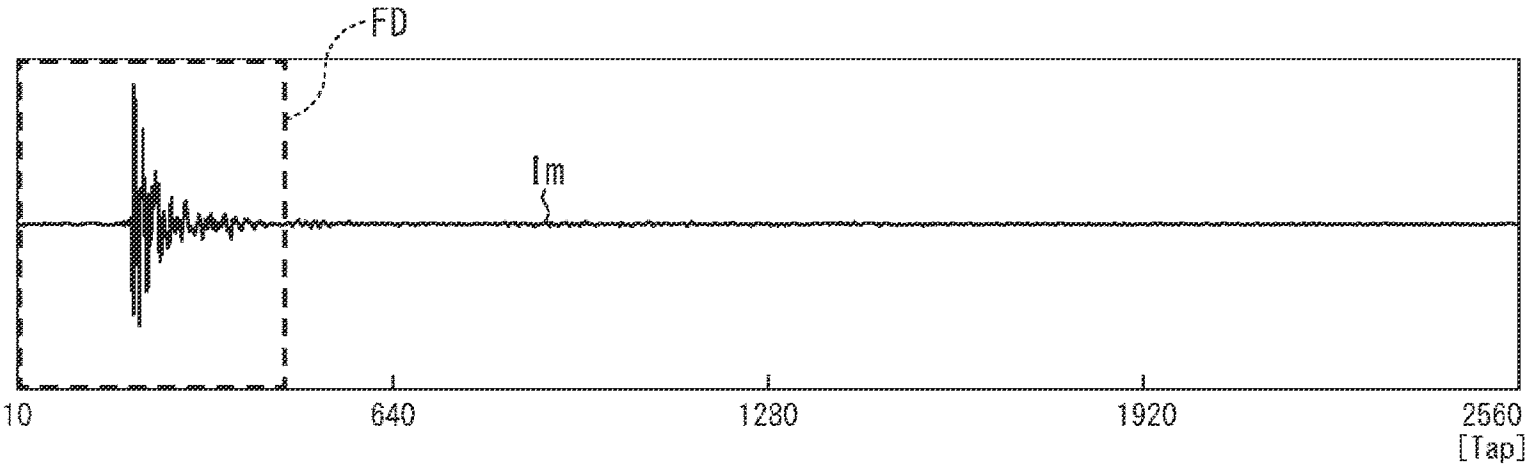
FIGS. 8A and 8B are graphs illustrating addition of a reverberation component.
Figure 8B:
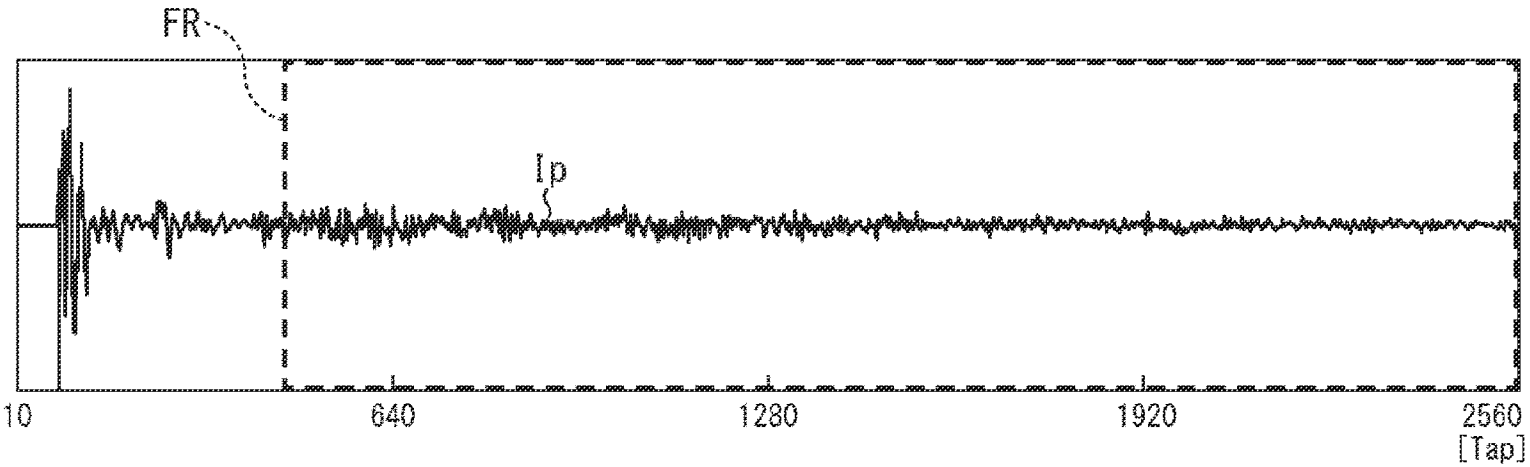

FIGS. 8A and 8B are graphs illustrating head impulse responses in which the actually measured head-related transfer function Hm and the preset head-related transfer function Hp are expressed in a time domain, respectively.

In FIG. 8A, the waveform surrounded by the broken line frame FD indicates a direct component of a head impulse response Im corresponding to the actually measured head-related transfer function Hm.

On the other hand, in FIG. 8B, the waveform surrounded by the broken line frame FR indicates a reverberation component of a head impulse response Ip corresponding to the preset head-related transfer function Hp.

In the example of FIGS. 8A and 8B, the reverberation component of the actually measured head impulse response Im has a waveform amplitude smaller than that of the preset head impulse response Ip. The magnitude relationship of those waveform amplitudes differs depending on the measurement environment using the speaker of the smartphone, and the reverberation component of the actually measured head impulse response Im may have a waveform amplitude larger than that of the preset head impulse response Ip.

In the reverberation component addition unit 162, the reverberation component separated from the head impulse response Ip is added to the head-related transfer function H from the synthesis unit 161. The head-related transfer function H to which the reverberation component is added is used for convolution in the output unit 57.

According to the process described above, even in the case of measuring a head-related transfer function of the user using a smartphone with a narrow reproduction band as a sound source, a head-related transfer function with sufficient characteristics can be obtained. That is, it becomes possible to readily achieve personalization of the head-related transfer functions in all bands without using large-scale equipment.

Furthermore, since the reverberation component of the head impulse response is not dependent on the individual, personalization of the head-related transfer function can be achieved even in a case where the preset head impulse response is added to the actually measured head impulse response. Moreover, even in the case of measuring a head-related transfer function with the user's arms extended, a sense of distance can be controlled in such a manner that a virtual sound source, which makes it sound as if a speaker were disposed at a distance of several meters, is localized on the basis of the reverberation characteristics of the preset head impulse response.

(Use of Noise-Canceling Microphone)

In the measurement of the head-related transfer function described above, a commercially available noise-canceling microphone (NC microphone) may be used as a microphone to be worn on the left and right ears of the user.

Figure 9:
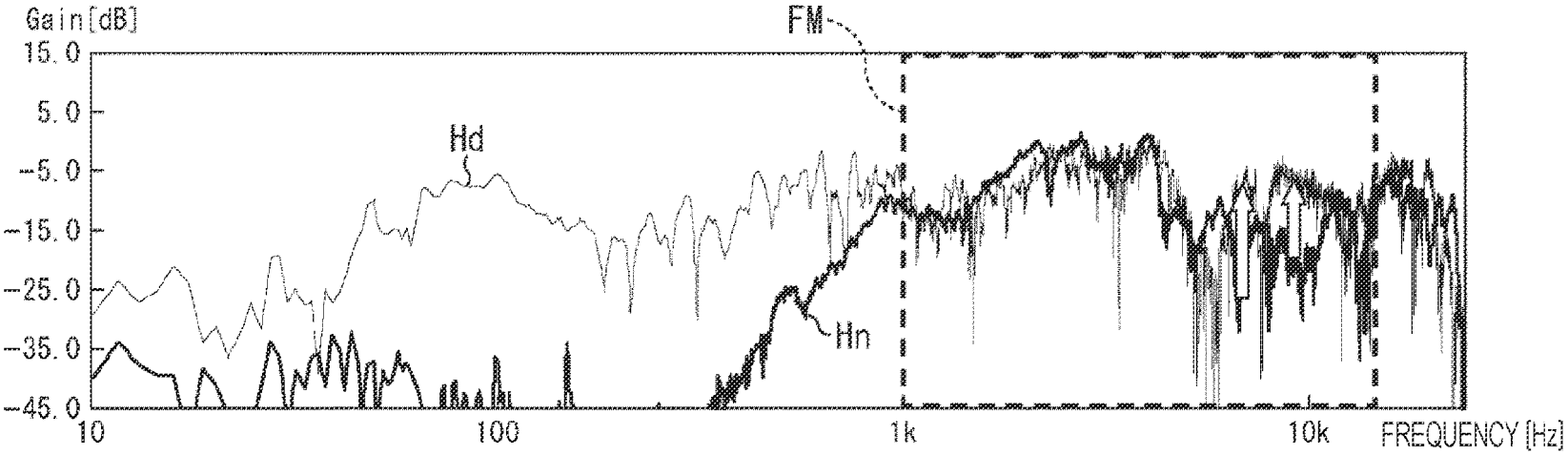
FIG. 9 is a graph illustrating correction of characteristics at the time of using an NC microphone.

FIG. 9 is a graph illustrating characteristics of a head-related transfer function Hn measured using an NC microphone and a smartphone speaker and a head-related transfer function Hd measured using a speaker and a microphone dedicated for measurement in an ideal measurement environment for the same listener.

In the figure, the gain of the head-related transfer function Hn is small in the band lower than 1 kHz as the gain of the smartphone speaker in that band is small.

Furthermore, in the midrange (band surrounded by the broken line frame FM) where the characteristics of the actually measured head-related transfer function are used, there may be a difference between the head-related transfer function Hd and the head-related transfer function Hn as indicated by the white arrows in the figure.

In view of the above, such difference data is recorded in advance for each NC microphone, and is used as a correction amount for the characteristics of the actually measured head-related transfer function. The correction based on the difference data is performed by, for example, the correction unit 112. With this arrangement, even in the case of using a commercially available NC microphone, the characteristics of the actually measured head-related transfer function can be brought close to the characteristics of the head-related transfer function measured in the ideal measurement environment.

(Timbre Change)

In the present embodiment, a timbre of a stereophonic sound can be changed without changing sound image localization of a virtual sound source.

Figure 10:
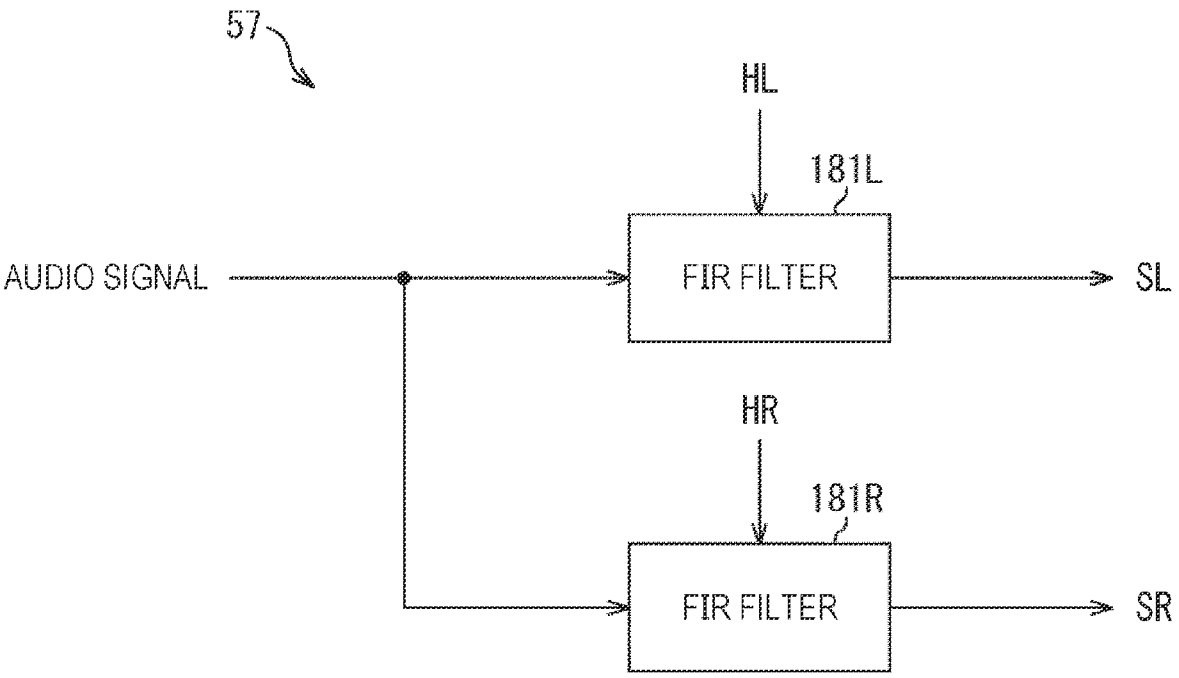
FIG. 10 is a diagram illustrating an exemplary configuration of an output unit.

FIG. 10 is a diagram illustrating an exemplary configuration of the output unit 57 (FIG. 2).

The output unit 57 is provided with finite impulse response (FIR) filters 181L and 181R.

The FIR filter 181L convolves, with respect to the audio signals from the audio input unit 56 (FIG. 2), a head-related transfer function HL for the left ear of the head-related transfer function H from the synthesis unit 55, thereby outputting audio signals SL for the left ear.

Similarly, the FIR filter 181R convolves, with respect to the audio signals from the audio input unit 56, a head-related transfer function HR for the right ear of the head-related transfer function H from the synthesis unit 55, thereby outputting audio signals SR for the right ear.

Note that the output unit 57 is provided with the configurations illustrated in FIG. 10 of the number of virtual sound sources to be localized, and the audio signals SL and SR from each configuration are added and synthesized to be output.

Figure 11:
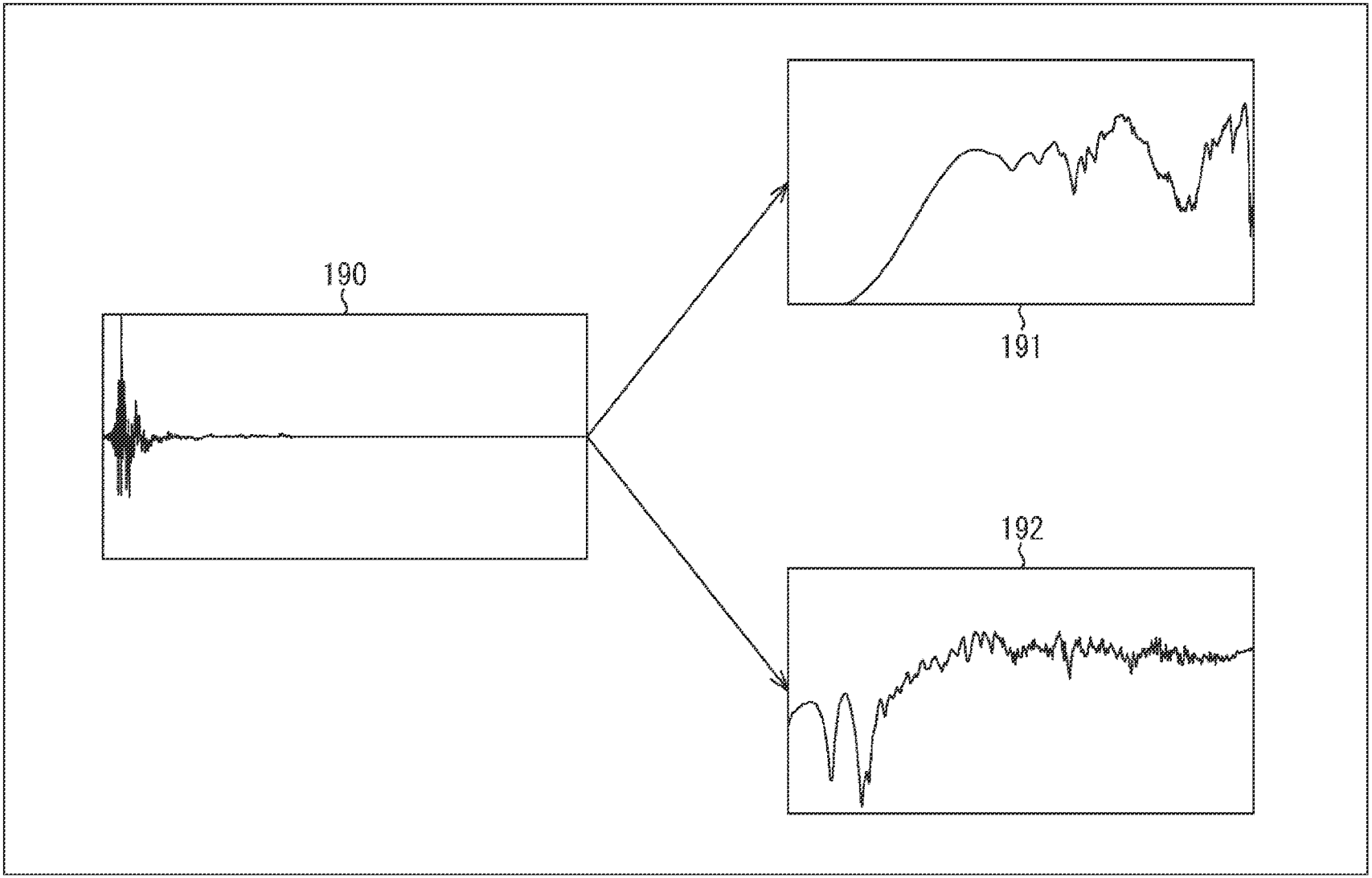
FIG. 11 is a diagram illustrating a change in frequency characteristics.

Since the FIR filters 181L and 181R have linear-phase characteristics, it is possible to change the frequency characteristics while maintaining the phase characteristics. For example, as illustrated in FIG. 11, by applying the FIR filters 181L and 181R to one impulse response 190, the frequency characteristics can be set to characteristics 191 or characteristics 192.

As a result, the timbre of the stereophonic sound can be changed to a timbre of another sound field without changing the personalized sound image localization.

3. Second Embodiment (Configuration of Mobile Terminal)

Figure 12:
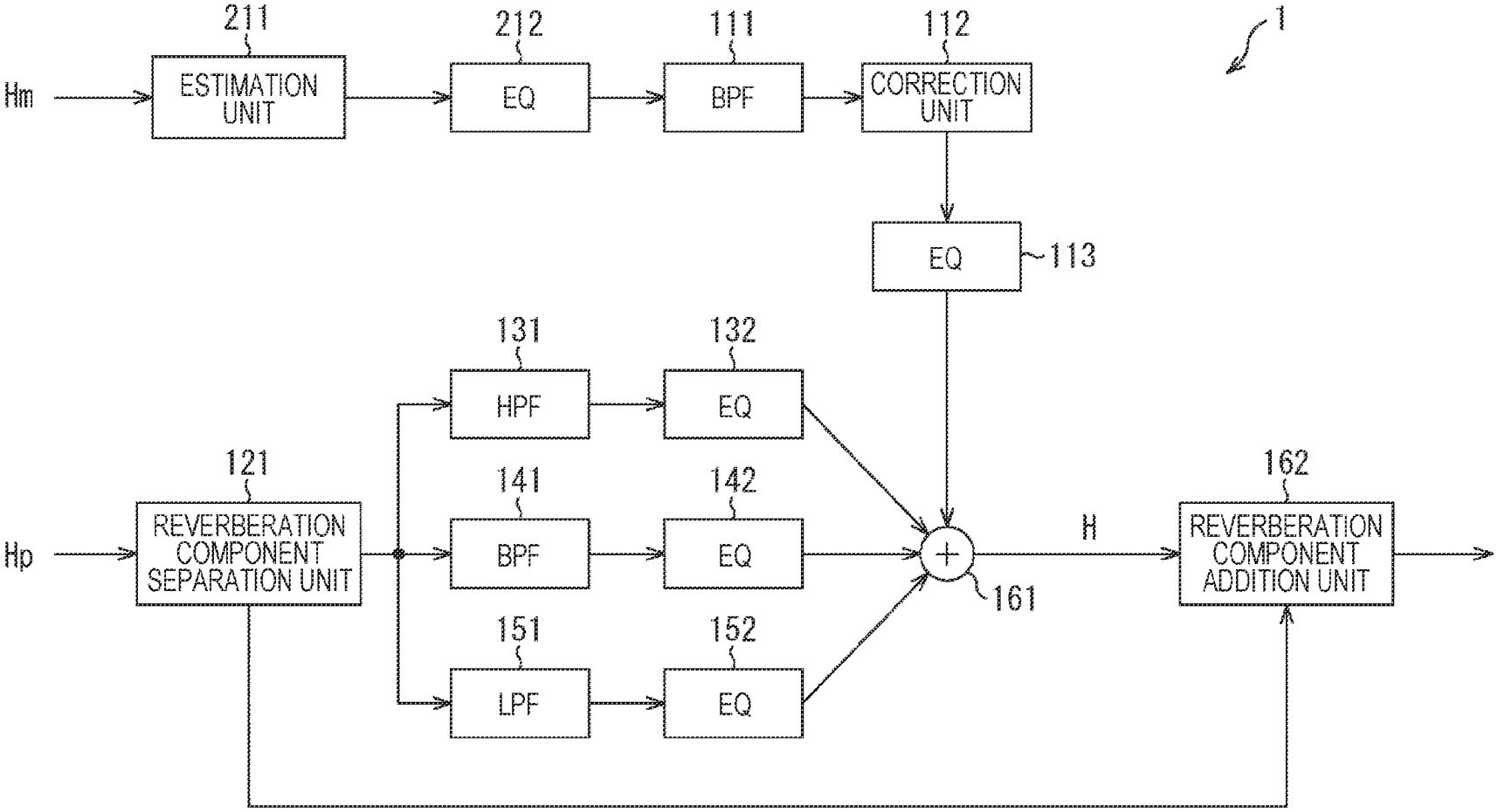
FIG. 12 is a block diagram illustrating an exemplary configuration of a mobile terminal according to a second embodiment.

FIG. 12 is a diagram illustrating an exemplary configuration of a mobile terminal 1 according to a second embodiment of the technique of the present disclosure.

The mobile terminal 1 of FIG. 12 has a configuration similar to that of the mobile terminal 1 of FIG. 4 except that an estimation unit 211 and an equalizer 212 are provided in a front stage of a bandpass filter 111.

The estimation unit 211 estimates, from an actually measured head-related transfer function Hm in a predetermined direction, a head-related transfer function in another direction. The actually measured head-related transfer function and the estimated head-related transfer function are supplied to the equalizer 212.

The equalizer 212 adjusts the frequency characteristics of the head-related transfer function from the estimation unit 211, and outputs it to the bandpass filter 111.

(Process of Generating Head-Related Transfer Function)

Figure 13:
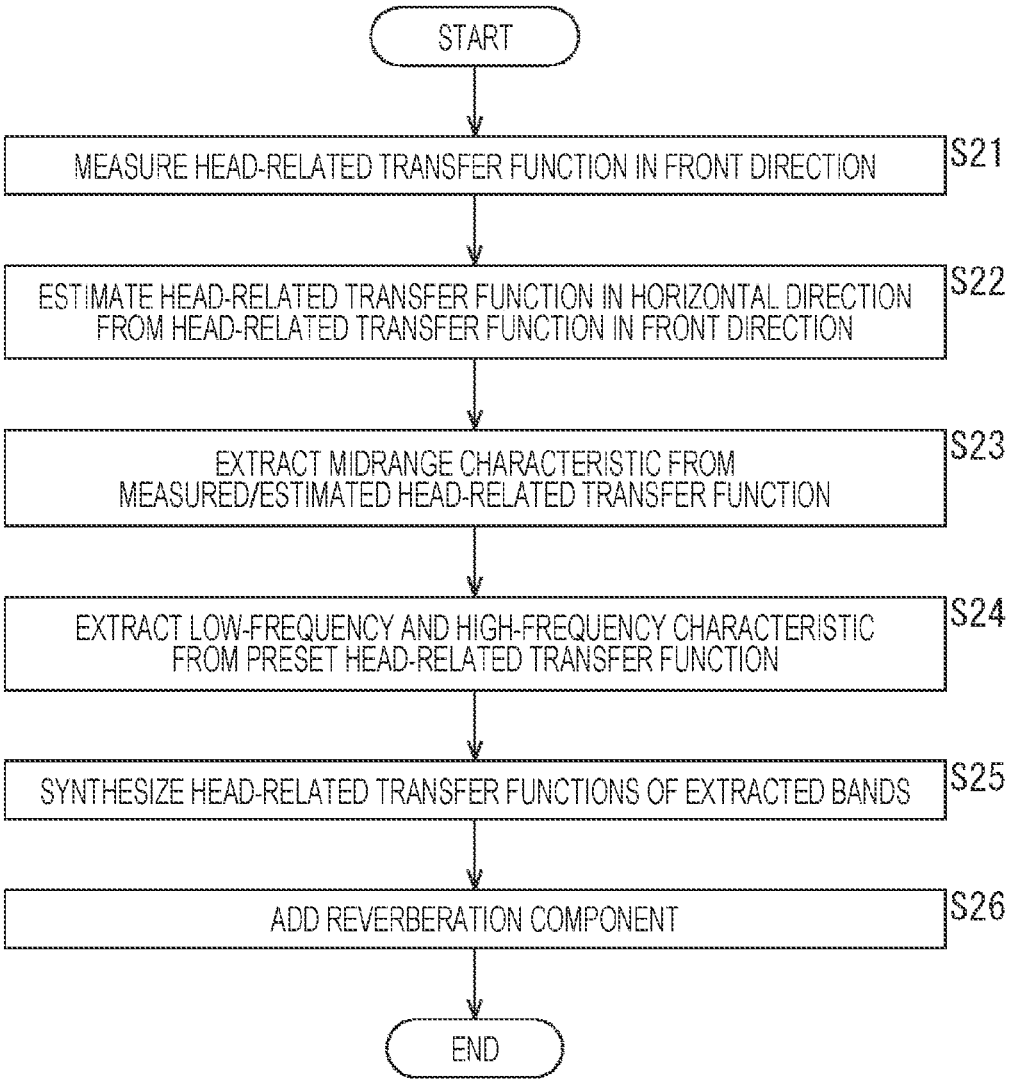
FIG. 13 is a flowchart illustrating a process of generating a head-related transfer function.

FIG. 13 is a flowchart illustrating the process of generating the head-related transfer function performed by the mobile terminal 1 of FIG. 12.

In step S21, the measurement unit 51 (FIG. 2) measures the head-related transfer function Hm in the front direction of a user by using a smartphone (mobile terminal 1) as a sound source. In this example, the head-related transfer function Hm is measured while the user holds the mobile terminal 1 in front and extends his/her arm.

In step S22, the estimation unit 211 estimates a head-related transfer function in the horizontal direction of the user from the measured head-related transfer function Hm in the front direction.

Here, estimation of the head-related transfer function in the horizontal direction will be described in detail.

Figure 14C:
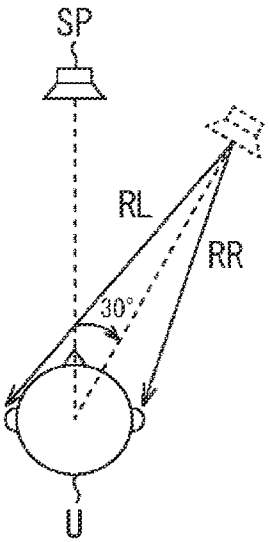
FIGS. 14A, 14B, and 14C are diagrams illustrating estimation of the head-related transfer function in the horizontal direction.
Figure 14B:
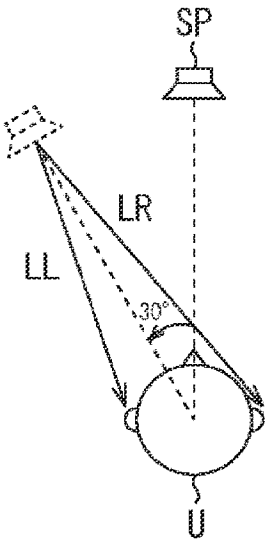
Figure 14A:
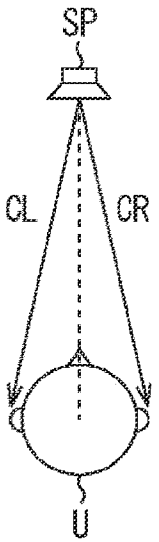

First, as illustrated in A of FIG. 14A, head-related transfer functions of the left and right ears measured by arranging a smartphone SP in the front direction of a user U are defined as CL and CR.

Next, as illustrated in FIG. 14B, head-related transfer functions of the left and right ears, which are to be estimation symmetry, in the direction of 30° to the left from the front direction of the user U are defined as LL and LR. Similarly, as illustrated in FIG. 14C, head-related transfer functions of the left and right ears, which are to be estimation symmetry, in the direction of 30° to the right from the front direction of the user U are defined as RL and RR.

Those four characteristics LL, LR, RL, and RR are estimated while being classified into the sunny side characteristics and the shade side characteristics according to the distance between the user U and the speaker of the smartphone SP. Specifically, LL and RR are characteristics on the side closer to the user U (sunny side) when viewed from the speaker, and thus classified as the sunny side characteristics. Furthermore, LR and RL are characteristics on the side (shade side) behind the speaker when viewed from the user U when viewed from the speaker, and thus classified as the shade side characteristics.

Since the sunny side characteristics have a larger direct component in which the sound from the speaker propagates directly to the ear, the gain in the midrange to the high-frequency range is larger than that of the characteristics obtained by the measurement in the front direction.

On the other hand, in the shade side characteristics, the sound from the speaker propagates around the head, whereby the gain in the high-frequency range is attenuated as compared with the characteristics obtained by the measurement in the front direction.

Furthermore, there is interaural time difference due to the difference in the distance from the speaker to the left and right ears.

Considering the physical transmission characteristics above, the correction items for the characteristics CL and CR in the front direction are set as the following two items.

Figure 15A:
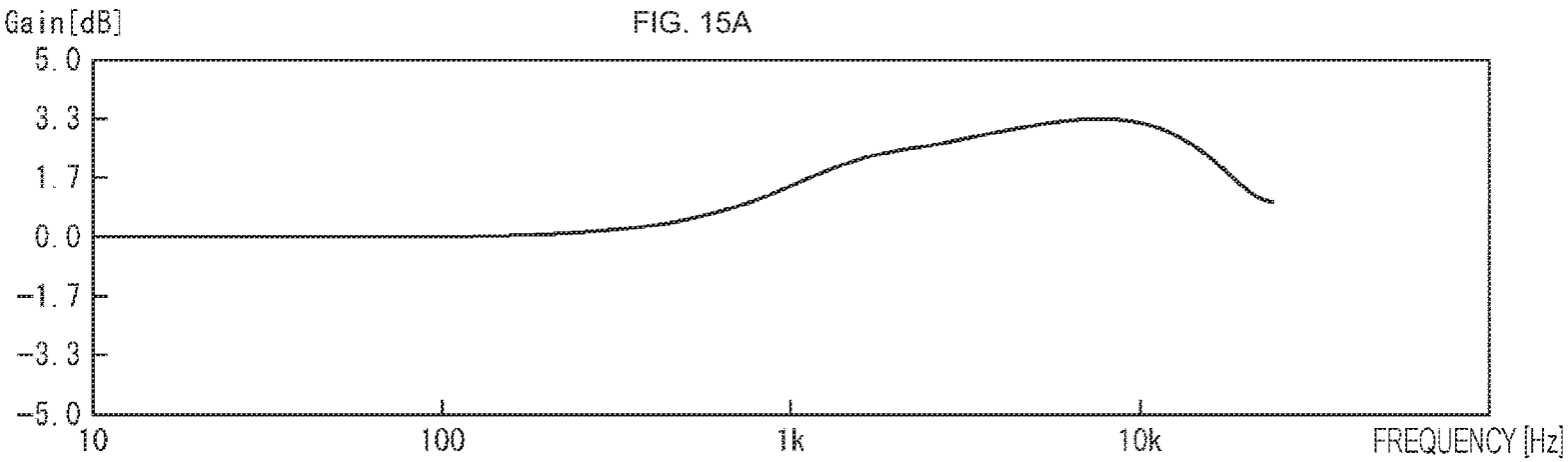
FIGS. 15A and 15B are graphs illustrating exemplary frequency characteristics of an estimation filter.
Figure 15B:
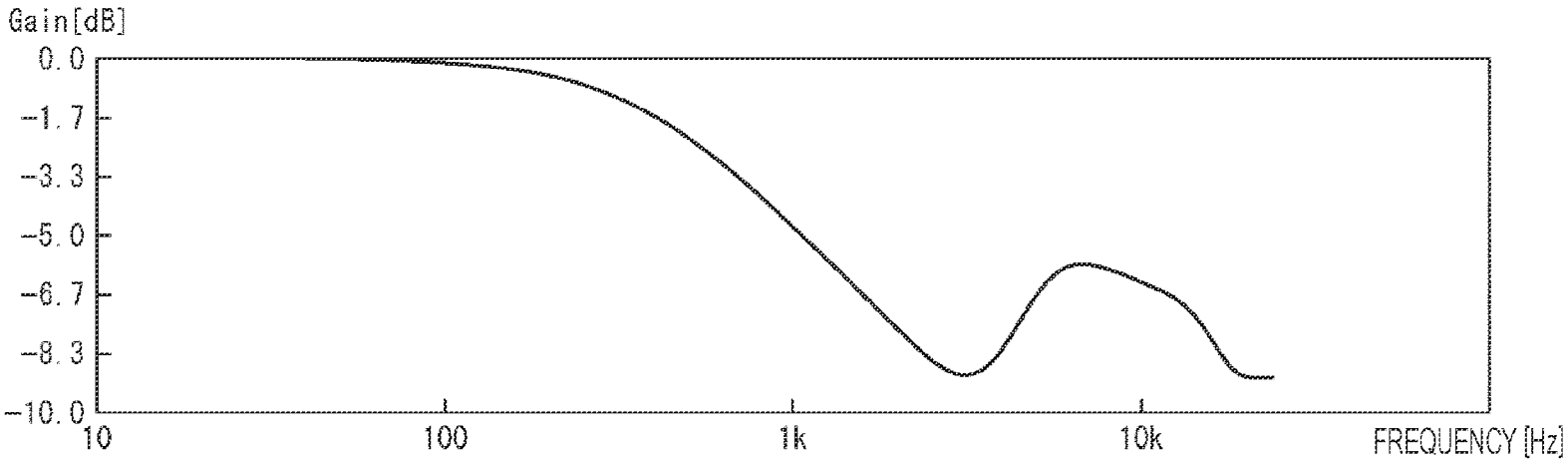

(1) Correction of the gain that reproduces the amplification of sound in the midrange to the high-frequency range and the attenuation of sound on the shade side of the head caused by the movement of the sound source in the horizontal direction (2) Correction of the delay associated with the change in distance from the sound source caused by the movement of the sound source in the horizontal direction FIGS. 15A and 15B are graphs illustrating frequency characteristics of an estimation filter that implements the correction of the two items mentioned above with respect to the characteristics CL and CR in the front direction.

FIG. 15A illustrates a sunny-side estimation filter for estimating sunny-side characteristics. In the sunny-side estimation filter, the gain increases in the midrange and the high-frequency range.

On the other hand, FIG. 15B illustrates a shade-side estimation filter for estimating shade-side characteristics. In the shade-side estimation filter, the gain is largely attenuated in the midrange and the high-frequency range.

Here, assuming that the impulse response of the sunny-side estimation filter is filti (t), the sunny-side characteristics LL and RR are estimated as follows.

$$LL(t)=\text{filti}(t)*CL(t)$$

$$RR(t)=\text{filti}(t)*CR(t)$$

Note that "*" indicates convolution.

Furthermore, assuming that the impulse response of the shade-side estimation filter is filtc (t), the shade-side characteristics RL and LR are estimated as follows.

$$RL(t)=\text{filtc}(t)*CL(t)$$

$$LR(t)=\text{filtc}(t)*CR(t)$$

The frequency characteristics of the head-related transfer functions in the horizontal direction estimated as described above are adjusted by the equalizer 212 together with the head-related transfer function in the front direction. Note that, as individual-dependent characteristics are unlikely to appear in the shade-side characteristics, preset characteristics prepared in advance may be used.

In step S23, the bandpass filter 111 extracts midrange characteristics from the measured/estimated head-related transfer functions. The frequency characteristics of the extracted midrange head-related transfer function are adjusted by an equalizer 113 after the characteristics of a speaker 18 are removed by a correction unit 112.

Note that the processing of step S24 and subsequent steps is similar to the processing of step S13 and subsequent steps in the flowchart of FIG. 5, and thus descriptions thereof will be omitted.

According to the process described above, even in the case of measuring a head-related transfer function of the user using a smartphone with a narrow reproduction band as a sound source, a head-related transfer function with sufficient characteristics can be obtained. That is, it becomes possible to readily achieve personalization of the head-related transfer functions in all bands without using large-scale equipment.

In particular, in the present embodiment, the head-related transfer function in the horizontal direction is estimated from the head-related transfer function in the front direction of the user, whereby personalization of the head-related transfer functions for localizing multiple virtual sound sources can be achieved on the basis of only one-time measurement of the head-related transfer function.

4. Third Embodiment

Hereinafter, an example of estimating, from a head-related transfer function for a median plane of a user, a head-related transfer function for a sagittal plane will be described.

Figure 16:
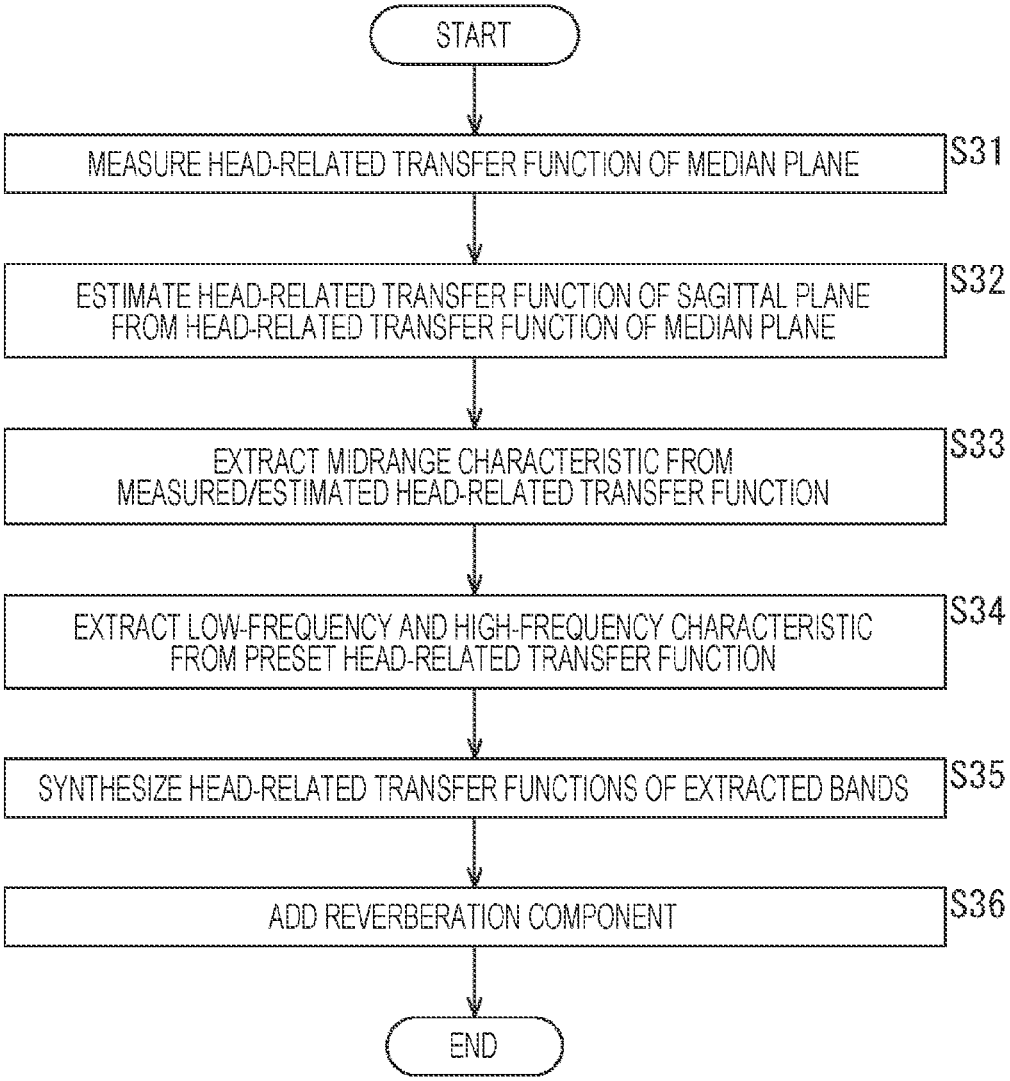
FIG. 16 is a flowchart illustrating a process of generating a head-related transfer function.

FIG. 16 is a flowchart illustrating another exemplary process of generating a head-related transfer function by the mobile terminal 1 of FIG. 12.

In step S31, the measurement unit 51 (FIG. 2) measures a head-related transfer function for the median plane of the user by using a smartphone (mobile terminal 1) as a sound source.

Figure 17B:
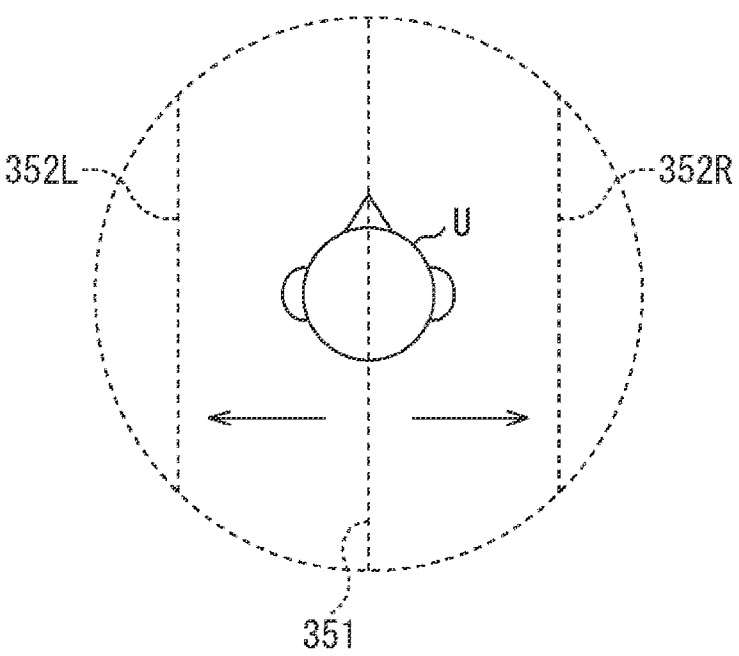
FIGS. 17A and 17B are diagrams illustrating measurement of the head-related transfer functions of a median plane and a sagittal plane.
Figure 17A:
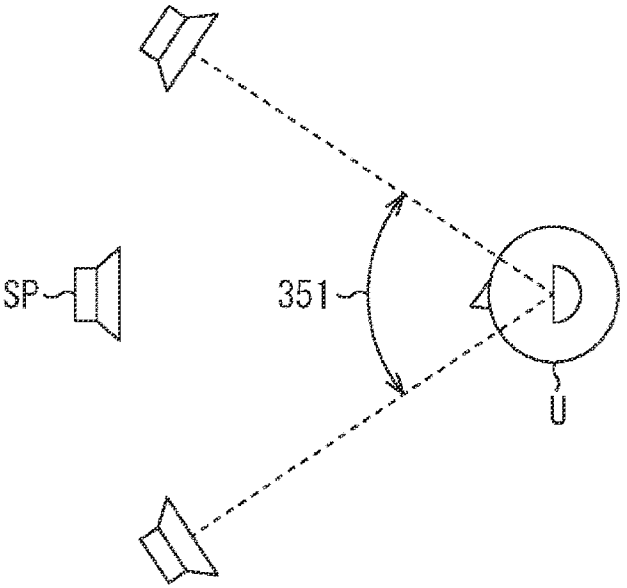

For example, as illustrated in FIG. 17A, a user U arranges a smartphone SP in a median plane 351, thereby measuring a head-related transfer function. In the example of FIGS. 17A and 17B, head-related transfer functions are measured in three directions including the front, diagonally above, and diagonally below the user within the median plane 351.

In step S32, an estimation unit 211 estimates head-related transfer functions of the left and right sagittal planes of the user from the measured head-related transfer function of the median plane.

For example, as illustrated in FIG. 17B, in the space where the user U exists, a head-related transfer function for a sagittal plane 352L parallel to the median plane 351 on the left side of the user U and a head-related transfer function for a sagittal plane 352R parallel to the median plane 351 on the right side of the user U are estimated.

The estimation of the head-related transfer functions here is achieved by correcting, using the sunny-side estimation filter and the shade-side estimation filter described above, the respective head-related transfer functions in three directions including the front, diagonally above, and diagonally below the user within the median plane 351, for example.

The frequency characteristics of the estimated head-related transfer functions of the sagittal planes are adjusted by an equalizer 212 together with the head-related transfer function of the median plane.

Note that the processing of step S33 and subsequent steps is similar to the processing of step S23 and subsequent steps in the flowchart of FIG. 13, and thus descriptions thereof will be omitted.

According to the process described above, even in the case of measuring a head-related transfer function of the user using a smartphone with a narrow reproduction band as a sound source, a head-related transfer function with sufficient characteristics can be obtained. That is, it becomes possible to readily achieve personalization of the head-related transfer functions in all bands without using large-scale equipment.

In particular, in the present embodiment, the head-related transfer function in an optional direction around the user is estimated, whereby personalization of the head-related transfer function for localizing a virtual sound source in a direction desired by the user can be achieved.

5. Others (Other Sound Source Examples)

Although a smartphone having a speaker is used as a sound source for reproducing measurement sound waves in the descriptions above, a device other than this may be used. For example, the sound source for reproducing the measurement sound waves may be a television receiver having a speaker and a display. A television receiver is capable of performing reproduction only up to a band of about 200 Hz, and its reproduction band is not wide in a similar manner to a smartphone.

According to the technique of the present disclosure, even in the case of measuring a head-related transfer function of the user using a television receiver with a narrow reproduction band as a sound source, a head-related transfer function with sufficient characteristics can be obtained.

(Application to Cloud Computing)

A signal processing device to which the technique according to the present disclosure is applied may employ a configuration of cloud computing in which one function is shared and jointly processed by a plurality of devices via a network.

Furthermore, each step described in the flowchart described above may be executed by one device or shared by a plurality of devices.

Moreover, in a case where a plurality of processes is included in one step, the plurality of processes included in the one step may be executed by one device or shared by a plurality of devices.

For example, the HRTF database 53 of FIG. 2 may be provided in a server or the like (what is called cloud) to be connected via a network such as the Internet.

Furthermore, all the configurations included in the mobile terminal 1 of FIG. 2 may be provided in the cloud. In this case, the mobile terminal 1 only transmits audio signals of the collected measurement sound waves to the cloud, and receives and reproduces audio signals for reproducing the stereophonic sound from the cloud.

(Processing Execution by Program)

The series of processing described above may be executed by hardware or by software. In the case of executing the series of processing by software, a program included in the software is installed from a program recording medium on a computer incorporated in dedicated hardware, a general-purpose personal computer, or the like.

Figure 18:
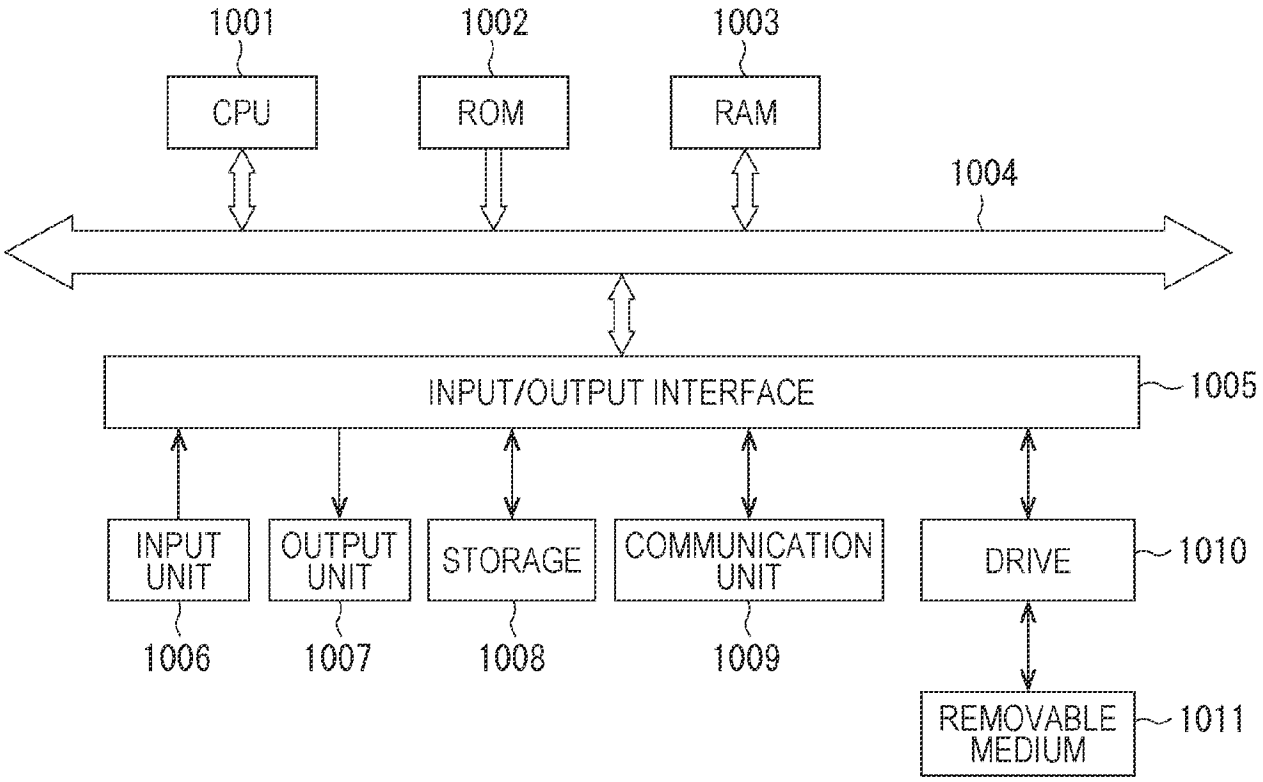
FIG. 18 is a block diagram illustrating an exemplary configuration of a computer.

FIG. 18 is a block diagram illustrating an exemplary hardware configuration of a computer that executes, using a program, the series of processing described above.

The mobile terminal 1 described above is constructed by a computer having the configuration illustrated in FIG. 18.

A central processing unit (CPU) 1001, a read-only memory (ROM) 1002, and a random access memory (RAM) 1003 are connected to each other by a bus 1004.

An input/output interface 1005 is further connected to the bus 1004. An input unit 1006 including a keyboard, a mouse, and the like, and an output unit 1007 including a display, a speaker, and the like are connected to the input/output interface 1005. Furthermore, a storage 1008 including a hard disk, a non-volatile memory, and the like, a communication unit 1009 including a network interface and the like, and a drive 1010 for driving a removable medium 1011 are connected to the input/output interface 1005.

In the computer configured as described above, for example, the CPU 1001 loads the program stored in the storage 1008 into the RAM 1003 via the input/output interface 1005 and the bus 1004 and executes the program, thereby performing the series of processing described above.

The program to be executed by the CPU 1001 is provided by, for example, the removable medium 1011 recording the program, or provided via a wired or wireless transmission medium such as a local area network, the Internet, and a digital broadcast, and is installed in the storage 1008.

Note that the program to be executed by the computer may be a program in which processing is executed in a time-series manner according to the order described in the present specification, or may be a program in which processing is executed in parallel or at a necessary timing such as a calling is performed.

Note that the embodiment of the present disclosure is not limited to the embodiments described above, and various modifications can be made without departing from the gist of the present disclosure.

Furthermore, the effects described herein are merely examples and not limited, and additional effects may be included.

Moreover, the present disclosure may employ the following configurations.

(1)

A signal processing device including:

a synthesis unit that generates a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

(2)

The signal processing device according to (1), in which the first band includes a band from a first frequency to a second frequency, and the second band includes a band lower than the first frequency and a band higher than the second frequency.

(3)

The signal processing device according to (1), in which the first band includes a band higher than a first frequency, and the second band includes a band lower than the first frequency.

(4)

The signal processing device according to any one of (1) to (3), in which the first head-related transfer function includes data actually measured using a sound source arranged by the user, and the second head-related transfer function includes preset data measured in advance in an ideal measurement environment.

(5)

The signal processing device according to (4), in which the first band includes a band including an individual-dependent characteristic.

(6)

The signal processing device according to (4) or (5), in which the second band includes a band in which the sound source cannot be reproduced.

(7)

The signal processing device according to any one of (4) to (6), in which the sound source includes a device including a speaker.

(8)

The signal processing device according to (7), in which the device further includes a display.

(9)

The signal processing device according to (8), in which the device includes a smartphone.

(10)

The signal processing device according to (8), in which the device includes a television receiver.

(11)

The signal processing device according to any one of (4) to (10), further including:

a correction unit that corrects the characteristic of the first band to remove a characteristic of the sound source included in the characteristic of the first band extracted from the first head-related transfer function.

(12)

The signal processing device according to any one of (1) to (11), further including:

an addition unit that adds a reverberation component separated from a head impulse response corresponding to the second head-related transfer function to the third head-related transfer function.

(13)

A signal processing method including causing a signal processing device to perform:

generating a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

(14)

A program causing a computer to perform:

generating a third head-related transfer function by synthesizing a characteristic of a first band extracted from a first head-related transfer function of a user and a characteristic of a second band other than the first band extracted from a second head-related transfer function measured in a second measurement environment different from a first measurement environment in which the first head-related transfer function is measured.

REFERENCE SIGNS LIST

1 Mobile terminal
51 Measurement unit
52 Band extraction unit
53 HRTF database
54 Band extraction unit
55 Synthesis unit
56 Audio input unit
57 Output unit

The invention claimed is:

1. A signal processing device, comprising:

cicuitry configured to:

obtain a first head-related transfer function in a first direction of a user;

estimate, based on the first head-related transfer function, a second head-related transfer function in at least one second direction of the user, wherein the at least one second direction is different from the first direction;

generate a third head-related transfer function based on synthesis of a characteristic of a first band extracted from the second head-related transfer function of the user measured in a first measurement environment and a characteristic of a second band extracted from a fourth head-related transfer function measured in a second measurement environment, wherein the second band is different from the first band, and the second measurement environment is different from the first measurement environment; and correct the characteristic of the first band to remove a characteristic of a sound source included in the characteristic of the first band extracted from the second head-related transfer function.

2. The signal processing device according to claim 1, wherein the first band includes a band from a first frequency to a second frequency, and the second band includes a third band and a fourth band, wherein the third band is lower than the first frequency, and the fourth band is higher than the second frequency.

3. The signal processing device according to claim 1, wherein the first band includes a band higher than a first frequency, and the second band includes a band lower than the first frequency.

4. The signal processing device according to claim 1, wherein the first head-related transfer function includes data measured based on the sound source arranged by the user, and the fourth head-related transfer function includes preset data measured in advance in an ideal measurement environment.

5. The signal processing device according to claim 4, wherein the first band includes a band including an individual-dependent characteristic.

6. The signal processing device according to claim 4, wherein the second band includes a band in which an individual-dependent characteristic cannot be reproduced.

7. The signal processing device according to claim 4, wherein the sound source includes a device including a speaker.

8. The signal processing device according to claim 7, wherein the device further includes a display.

9. The signal processing device according to claim 8, wherein the device includes a smartphone.

10. The signal processing device according to claim 8, wherein the device includes a television receiver.

11. The signal processing device according to claim 1, wherein the circuitry is further configured to control addition of a reverberation component to the third head-related transfer function, wherein the reverberation component is separated from a head impulse response corresponding to the fourth head-related transfer function.

12. A signal processing method, comprising:

obtaining a first head-related transfer function in a first direction of a user;

estimating, based on the first head-related transfer function, a second head-related transfer function in at least one second direction of the user, wherein the at least one second direction is different from the first direction;

generating a third head-related transfer function based on synthesis of a characteristic of a first band extracted from the second head-related transfer function of the user measured in a first measurement environment and a characteristic of a second band extracted from a fourth head-related transfer function measured in a second measurement environment, wherein the second band is different from the first band, and the second measurement environment is different from the first measurement environment; and correcting the characteristic of the first band to remove a characteristic of a sound source included in the characteristic of the first band extracted from the second head-related transfer function.

13. A non-transitory computer-readable medium having stored thereon computer-executable instructions that, when executed by a processor, cause the processor to execute operations, the operations comprising:

obtaining a first head-related transfer function in a first direction of a user;

estimating, based on the first head-related transfer function, a second head-related transfer function in at least one second direction of the user, wherein the at least one second direction is different from the first direction;

generating a third head-related transfer function based on synthesis of a characteristic of a first band extracted from the second head-related transfer function of the user measured in a first measurement environment and a characteristic of a second band extracted from a fourth head-related transfer function measured in a second measurement environment, wherein the second band is different from the first band, and the second measurement environment is different from the first measurement environment; and correcting the characteristic of the first band to remove a characteristic of a sound source included in the characteristic of the first band extracted from the second head-related transfer function.

* * * * *